United States Patent [19]

Schaffer

[11] 4,376,509

[45] Mar. 15, 1983

[54] LIQUID CONTAINER WITH CARRYING HANDLE

[76] Inventor: George H. Schaffer, 607 Burritt St., Plantsville, Conn. 06479

[21] Appl. No.: 169,942

[22] Filed: Jul. 18, 1980

[51] Int. Cl.[3] ..... B65D 5/46; B65D 5/66; B65D 5/74

[52] U.S. Cl. ..... 229/52 B; 229/7 R; 229/17 R

[58] Field of Search ..... 229/52 A, 52 B, 17 R, 229/7 R

[56] References Cited

U.S. PATENT DOCUMENTS

| | | | |
|---|---|---|---|
| 2,085,979 | 7/1937 | Hathersall | 229/52 A |
| 2,404,312 | 7/1946 | Reynolds | 229/17 R |
| 2,496,336 | 2/1950 | Cupo | 229/17 R |
| 2,593,019 | 4/1952 | Glaser | 229/17 R |
| 3,078,032 | 2/1963 | Robinson | 229/52 B |

FOREIGN PATENT DOCUMENTS

| | | | |
|---|---|---|---|
| 1240549 | 7/1971 | United Kingdom | 229/52 B |

*Primary Examiner*—Herbert F. Ross

[57] ABSTRACT

A liquid-carrying container, made from plasticized and/or waxed cardboard, the container being preferably blanked from a single sheet, and including a carrying handle across its top, and also a recess in the top, for placement of a finger under the handle.

3 Claims, 5 Drawing Figures

LIQUID CONTAINER WITH CARRYING HANDLE

This invention relates generally to liquid-carrying containers made from coated cardboard, and such as are used for milk, juices, soft drinks and the like.

A principal object of the present invention is to provide a liquid-carrying container made of coated paper, and which includes a carrying handle, so that it can be conveniently transported by holding it with only one finger, instead of the need of an entire hand to grasp around it.

Another object is to provide a liquid-carrying container with handle, and which can be made in different sizes, such as from a one-half pint to a gallon, and which is of disposable type, after a single use.

Other objects of the present invention are to provide a liquid container with carrying handle, which is simple in design, inexpensive to manufacture, rugged in construction, easy to use and efficient in operation.

These, and other objects, will be readily evident, upon a study of the following specification, and the accompanying drawing, wherein.

Figure 1:
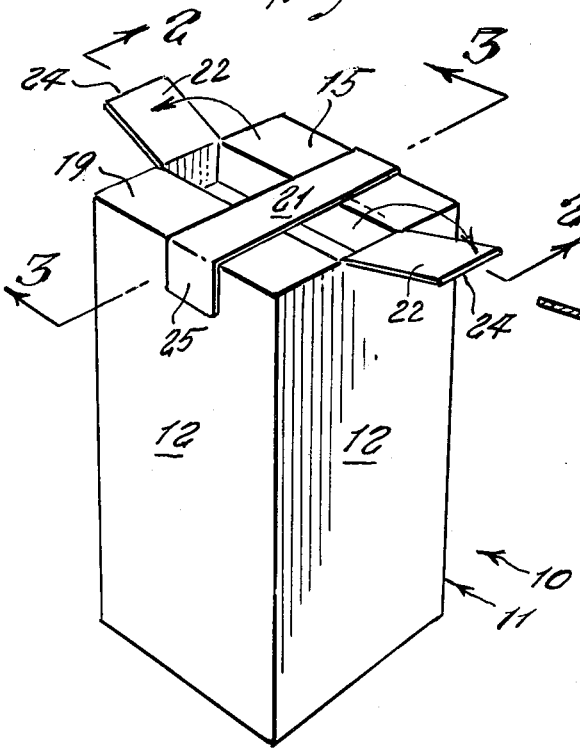
FIG. 1 is a perspective view of the invention, shown with flaps pulled out so as to allow insertion of a finger under the carrying handle.

Referring now to the drawing in greater detail, the reference numeral 10 represents the present invention, wherein there is a container 11, that may possibly be made from a single sheet of blanked-out or die-cut cardboard, which is pre-printed and coated with a plasticized and/or waxed finish.

The container includes four side walls 12, bottom wall 13, and a configurated top wall 14, comprising sections 15, 16, 17, 18 and 19, along with tabs 20 for heat sealing against the side walls. A long tab, for forming a handle 21, is along an upper edge of the blanked-out sheet. Also, a pair of side tabs 22 are also along the upper edge, and serve to close a recess 23, by means of the end edges 24 thereof fitting under side edges of the handle 21, when the container is fully closed. Heat sealing tabs 25, around the bottom wall, along one side edge of one of the side walls, and at one end of the handle, are also provided in order that the container may thus be formed.

Figure 2:
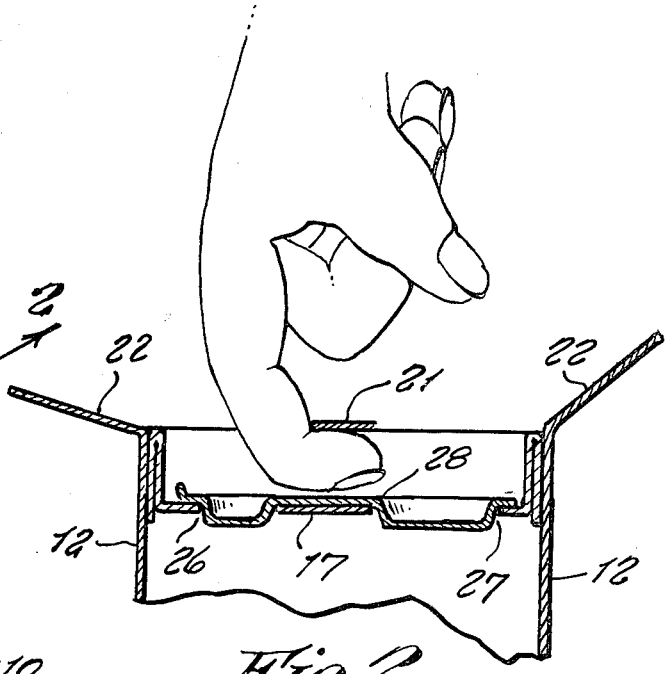
FIG. 2 is an enlarged fragmentary cross-sectional view, taken on line 2—2 of FIG. 1.
Figure 3:
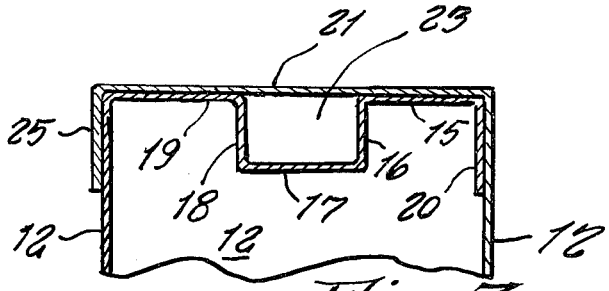
FIG. 3 is an enlarged fragmentary cross-sectional view, taken on line 3—3 of FIG. 1.
Figure 4:
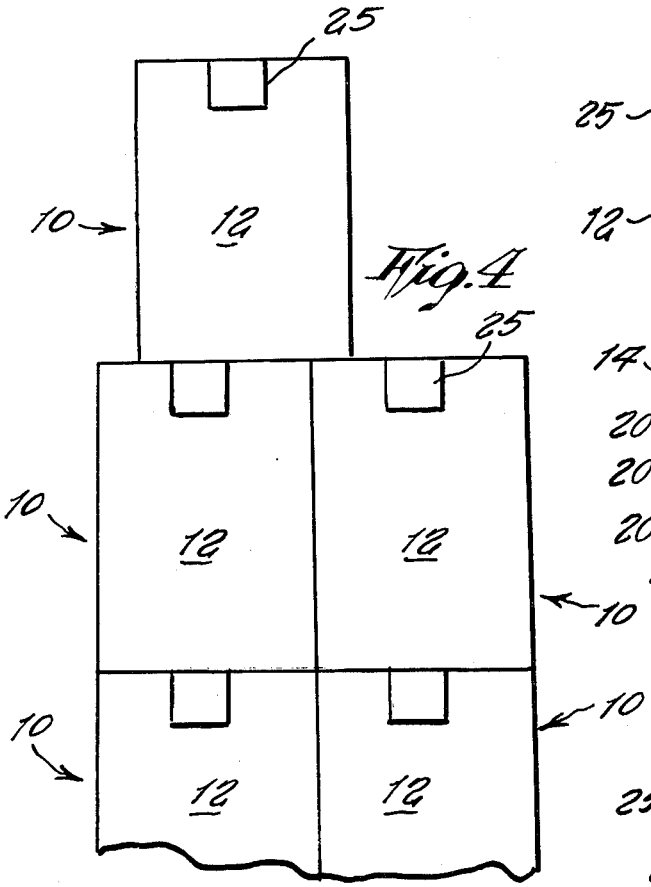
FIG. 4 is a side view of several of the containers, stacked one upon another.
Figure 5:
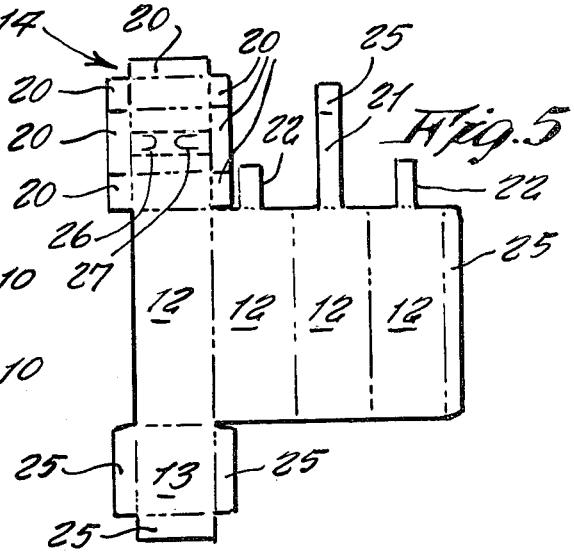
FIG. 5 shows a blank, from which the entire container and handle can be formed.

The top wall section 17 may include pouring spouts 26 and 27, of different size, scored in opposite end areas thereof, that can be torn and lifted for use, or else, as shown in FIG. 2, a separate cardboard double cap member 28 may be heat sealed thereupon, so to reclose the pouring spouts.

In use, when the tabs 22 are either pulled out, as shown in FIG. 1, or else are downward depressed, a person's finger 29 fits in the recess 30, so as to extend under the handle for carrying. To pour beverages, either spout is lifted.

It will be noted, that tabs 22 protect the spout areas from dirt or other contamination, before a consumer purchases the product.

While various changes may be made in the detail construction, it is understood that such changes will be within the spirit and scope of the present invention, as is defined by the appended claims.

What I now claim is:

1. A liquid container with carrying handle, comprising, in combination, a rectangular-shaped container member that is blanked from a flat, plasticized sheet of cardboard, said container member including a bottom, a top and side walls bent up to form said container member, and including a downward recess across the top of said top wall, a carrying handle extending across said top wall and transversely spanning said cover and recess thereby allowing a person's finger to pass under said handle, two pouring spouts in said top wall recess, a pair of pivotable tabs extending from opposite ends of said recess to overlie said recess and cover said two pouring spouts, the distal end edges of said tabs extending under side edges of said handle.

2. The combination as set forth in claim 1, wherein each said pouring spout is a different size.

3. The combination as set forth in claim 2, wherein a double cap member heat sealed at its center upon said top wall, selectively closes both said pouring spouts.

* * * * *